United States Patent [19]

Kent et al.

[11] Patent Number: 4,944,452

[45] Date of Patent: Jul. 31, 1990

[54] MULTIPLE PIZZA CONTAINER

[76] Inventors: Walter R. Kent, 1732 120th Ave., Allegan, Mich. 49010; Terrence L. Guerrant, 2027 114th Ave., Otsego, Mich. 49078

[21] Appl. No.: 413,238

[22] Filed: Sep. 27, 1989

[51] Int. Cl.[5] ..... B65D 5/48

[52] U.S. Cl. ..... 229/120.21; 206/45.19; 229/906

[58] Field of Search ..... 229/120.21, 120.32, 229/902, 906, 2.5 R, 72; 206/45.19; D9/341, 346, 430–432

[56] References Cited

U.S. PATENT DOCUMENTS

| | | | |
|---|---|---|---|
| Re. 21,592 | 10/1940 | Addis et al. | 229/120.21 |
| 2,375,843 | 5/1945 | Gottlieb | 206/45.19 |
| 2,510,211 | 6/1950 | Cleary | 229/120.32 |
| 2,676,748 | 4/1954 | Sprenger et al. | 229/120.21 |
| 2,850,224 | 9/1958 | Meinhardt et al. | 229/120.21 |
| 3,266,712 | 8/1966 | McCleneghan | 229/72 |
| 3,572,577 | 3/1971 | Dorfman | 206/509 |
| 3,899,119 | 8/1975 | Roccaforte | 206/45.19 |
| 4,009,821 | 3/1977 | Hambleton | 229/122 |
| 4,301,960 | 11/1981 | Alexander et al. | 229/906 |
| 4,438,848 | 3/1984 | Montealegre et al. | 229/120.21 |
| 4,441,626 | 4/1984 | Hall | 220/443 |
| 4,836,383 | 6/1989 | Gordon et al. | 229/120.21 |

FOREIGN PATENT DOCUMENTS

| | | | |
|---|---|---|---|
| 1225103 | 9/1966 | Fed. Rep. of Germany | 229/2.5 R |

*Primary Examiner*—Gary E. Elkins
*Attorney, Agent, or Firm*—Leon Gilden

[57] ABSTRACT

A multiple pizza container box is formed of a single, double-sided corrugated blank including a matrix of score and fold lines to enable interfolding of the blank. The blank is formed of three major planar surfaces including a floor panel, a middle panel, and a top wall, wherein the blank is of an "L" shaped configuration to enable positioning of a first pizza on the floor panel, then enabling subsequent over-folding of the middle panel to overlie the floor panel to enable positioning of a second pizza on the middle panel and subsequently permit over-folding of the top wall to provide a stacked enclosure for secure transport of multiple pizzas therewithin. Proximity of the pizzas in a stacked relationship enhances the retention of heat within the container.

7 Claims, 2 Drawing Sheets

MULTIPLE PIZZA CONTAINER

BACKGROUND OF THE INVENTION

1. Field of the Invention

The field of invention relates to pizza boxes, and more particularly pertains to a new and improved multiple pizza transport container wherein the same enables securement of multiple pizzas in individual compartments within the container and furthermore, the container is made of a single unitary blank.

2. Description of the Prior Art

The use of pizza containers for transport of heated items therewithin, as well as containers adapted for specialized securement of various articles, is well known in the prior art. Heretofore, however, the prior art has failed to produce a multiple compartmentalized container utilizing over-folded panels selectively and reusably mounted on a single blank of the container to enable enhanced ease of use of such containers, as well as minimizing productions costs of such containers. Further, the advent of multiple pizza sales has induced and effected a need for such compartment container organizations. Examples of the prior art include U.S. Pat. No. 2,510,211 to Cleary utilizing a stacked container arrangement wherein a separate member is positioned between overlying pivot containers, and wherein the top container is devoid of a unitary covering member, as set forth by the instant invention.

U.S. Pat. No. 2,676,748 to Sprenger sets forth a compartmented tray utilizing laterally spaced compartments for subsequent over-folding of a transparent wrap to secure various articles in a laterally offset and aligned relationship relative to one another.

U.S. Pat No. 8,572,577 to Dorfman provides a tray organization wherein the trays may be stacked upon one another, but again fails to provide the construction of a single unitary blank container of multiple compartments as set forth by the instant invention.

U S. Pat. No. 4,009,821 to Hambleton sets forth a heated food transport container concentrating on the particular laminated construction of the blank to provide containment of heat therewithin, but fails to set forth a multiple container as set forth by the instant invention.

U.S. Pat. No. 4,441,626 to Hall sets forth a conventional pizza-type transport container for securement of commercial pizzas therewithin and their transport.

As such, it may be appreciated that there is a continuing need for a new and improved multiple pizza container that addresses both the problems of ease of use and effectiveness in construction, and in this respect, the present invention substantially fulfills this need.

SUMMARY OF THE INVENTION

In view of the foregoing disadvantages inherent in the known types of pizza boxes now present in the prior art, the present invention provides a multiple pizza container wherein the same enables compartmentalizing and subsequent transport of a plurality of pizzas within a container formed with a single blank. As such, the general purpose of the present invention, which will be described subsequently in greater detail, is to provide a new and improved multiple pizza container which has all the advantages of the prior art pizza containers and none of the disadvantages.

To attain this, the multiple pizza container of the instant invention is formed of a single "L" shaped blank formed with a medial floor panel with a middle and top wall panel mounted at a 90 degree relationship relative to one another and pivotally mounted to the floor panel by perforated and creased flap portions securable to one another by a hinged relationship effected by the perforating and creasing orientation of the flap panels. Positioning tabs align the upper top wall panel and its associated side wall and forward flap portions and maintain the top wall panel in registration overlying the middle and floor panels in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar a they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple pizza container which has all the advantages of the prior art pizza containers and none of the disadvantages.

It is another object of the present invention to provide a new and improved multiple pizza container which may be easily and efficiently manufactured and marketed.

It is a further object of the present invention to provide a new and improved multiple pizza container which is of a durable and reliable construction.

An even further object of the present invention is to provide a new and improved multiple pizza container which is susceptible of a low cost of manufacture with regard to both materials and labor, and which accordingly is then susceptible of low prices of sale to the consuming public, thereby making such multiple pizza containers economically available to the buying public.

Still yet another object of the present invention is to provide a new and improved multiple pizza container which provides in the apparatuses and methods of the prior art some of the advantages thereof, while simultaneously overcoming some of the disadvantages normally associated therewith.

Still another object of the present invention is to provide a new and improved multiple pizza container wherein the same is fabricated of a single "L" shaped cardboard blank to provide rigidity and efficiency in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
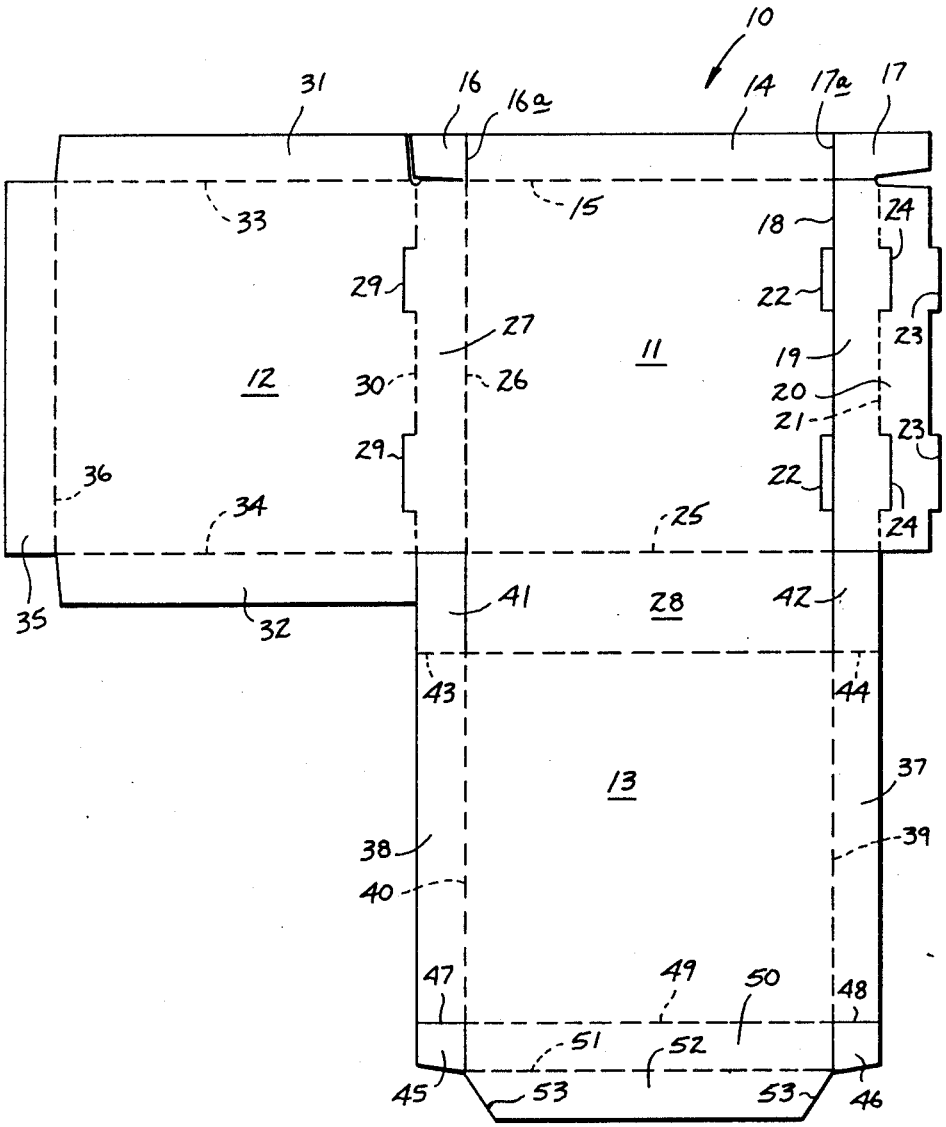
FIG. 1 is a top plan view of the blank utilized in the construction of the instant invention.
Figure 2:
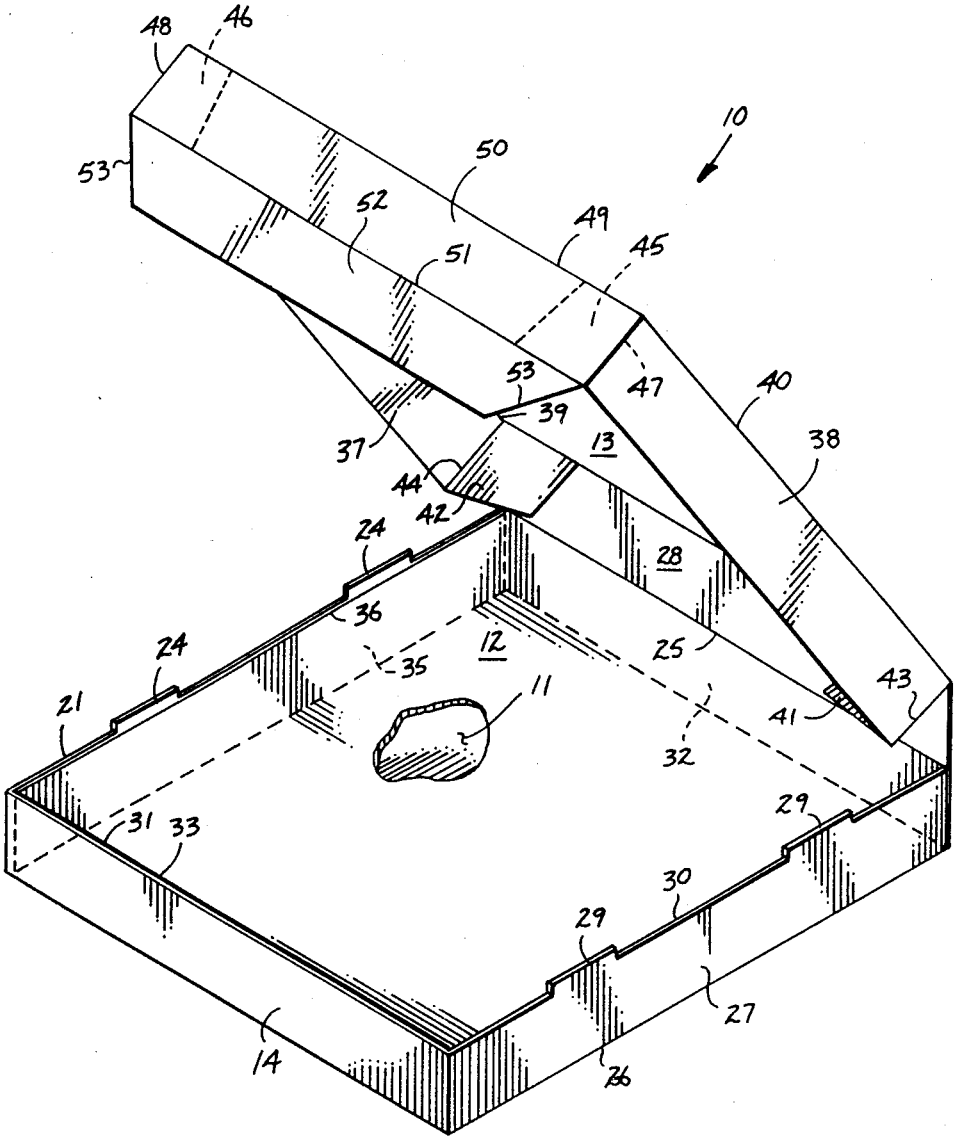
FIG. 2 is an isometric illustration of the multiple pizza container of the instant invention subsequent to its erection from the planar blank as illustrated in FIG. 1.

With reference now to the drawings, and in particular to FIGS. 1 and 2 thereof, a new and improved multiple pizza container embodying the principles and concepts of the present invention and generally designated by the reference numeral 10 will be described.

More specifically, the multiple pizza container 10 essentially comprises a unitary "L" shaped blank, as illustrated in FIG. 1, formed of a relatively stiff cardboard-like material including three major panels defined by a floor panel 11 positioned at the juncture of the "L" shaped panel, with a middle panel 12 mounted to a left side of the floor panel 11, with a top wall panel 10 mounted to a bottom most portion of the floor panel 11. The floor panel 11 includes a rectangular first wall 14 hingedly mounted to the upper end of the floor panel 11 by a first elongate perforated hinge line 15. Each end of the first wall 14 includes a respective first and second end flap 16 and 17 positioned to left and right sides of the first wall 14 and hingedly mounted thereto by respective first and second score hinged lines **16*a* and 17*a*. A first score line 18 mounts a right side wall first panel 19 hingedly to the right side of the floor panel 11 with a right side wall second panel 20 by means of a second perforated hinge line 21 parallel to the first score line 18 mounts the right side wall second panel 20 to the right side wall first panel 19. A plurality of enclosed rectangular slots 22 are formed through the floor panel 11 with an elongate border mounted coextensively with the first score line border 18. The locking tabs 28 project exteriorly of the right side wall second panel 20 and when the right side wall second panel 20 is over-folded about the second perforated hinge line 21, the locking tabs 23 are aligned and interfit within the aforenoted rectangular slots 22. Die cut tabs, including a first pair of positioning tabs 24, are mounted in alignment with the rectangular slots 22 and the locking tabs 23 and extend through the right side wall second panel 20. As illustrated in FIG. 2 for example, the first pair of positioning tabs 24 extend above the second perforated hinge line 21 to align respective side walls of the top panel 13 in cooperation with a second pair of positioning tabs 29 that are formed through the middle panel 12 and mounted integrally to the left side wall panel 27 that in turn is hingedly mounted to the floor panel 11 by means of a fourth perforated hinge line 26. A third perforated hinge line 25 hingedly mounts the bottom side wall panel 28 to the floor panel 11, where it is noted that the bottom side wall panel 28 is of a width substantially twice that of the first wall 14, right side wall first panel 19, right side wall second panel 20, and left side wall panel 27. The bottom side wall 28 forms a side wall of the bottom container, as illustrated in FIG. 2, as well as serving as a side wall for the upper container when the top wall panel 13 is over-folded and interengaged between the first wall 14 and an upper flap wall 31 of the middle panel 12. The upper flap wall 31 is mounted by use of a sixth perforated hinge line 33 to an uppermost portion of the middle panel 12. Further, a fifth perforated hinge line 30 mounts the middle panel 12 to the left side wall panel 27, as illustrated in FIG. 1, with the second pair of positioning tabs 29 formed through the middle panel 12 to project above the left side wall panel 27 when the left side wall panel 27 is folded at a 90 degree relationship relative to the forward panel 11. A lower flap wall 32 utilizes a seventh perforated hinge line 34 to hingedly mount the lower flap wall 32 to a bottom portion of the middle panel 12 with a middle panel end flap 35 hingedly mounted to a left side of the middle panel 12 by use of an eighth perforated hinge line 36**.

The top panel 13 includes a top panel right wall 37 and a top panel left wall 38, each mounted to the top panel by coextensive elongate respective perforated hinge lines comprising a ninth perforated hinge line 39 and a tenth perforated hinge line 40 respectively. A first positioning flap 41 is hingedly mounted to the top panel left wall 38 by a first positioning hinge 43, with a second positioning flap 42 pivotally mounted to the top panel right wall 37 by a second positioning hinge 44. A third positioning flap 45 is mounted to a bottom end of the top panel left wall 38 by a third positioning hinge 47, with a fourth positioning flap 46 pivotally mounted to a bottommost portion of the top panel right wall 87 by a fourth positioning hinge 48. An eleventh perforated hinge line 49 is aligned with the third and fourth positioning hinges 47 and 48 and directed coextensively across the lowermost border of the top wall panel 13, wherein the eleventh perforated hinge line 49 hingedly mounts the forward wall 50 to the top wall panel 13, with a twelfth perforated hinge line 51 parallel and of equal length to the eleventh perforated hinge line 40 mounting a lock panel 52 formed with inwardly tapered side edges 53 towards a forward free edge, wherein the lock panel 52 is oriented for reception between the first wall 14 and the upper flap wall 31 when the middle panel 12 and the associated side walls are positioned within a compartment defined by the floor panel 11 and its associated side walls, as illustrated in FIG. 2. As illustrated in FIG. 2 therefore, it should be noted that a pizza to be transported is initially positioned upon the floor panel 11 prior to the over-folding and tucking of the middle panel 12 to overlie the floor panel. Subsequent to the positioning of a pizza upon the floor panel 11 and an over-folding of the middle panel 12, as illustrated in FIG. 2, a second pizza may be positioned upon an upper surface of the middle panel 12 enabling an over-folding of the top wall panel 13 and a tucking of the lock panel 52 between the first wall 14 and the upper flap wall 31 of the middle panel, as illustrated. The positioning tab pairs 24 and 29 maintain the respective right and left walls 37 and 38 of the top panel 13 in alignment with the respective side walls 19 and 27 of the floor panel 11. It may be further noted that the first end flap 16 is pivoted about its respective first score line hinge **16*a* and positioned interiorly of the left side wall panel 27 when the first wall 14 is erected in orthogonal relationship relative to the floor panel 11. Similarly, the second flap 17 is pivoted in orthogonal relationship relative to the first wall 14 about the second score line hinge 17*a* and is positioned interiorly of the right side wall first panel 19 and the right side wall second panel 20 when the second panel 20 is over-folded about the second perforated hinge line 21 and the locking tabs 23 inserted within the associated rectangular slots 22 aligned with the locking tabs 23. This effects rigidity and geometrical integrity to the organization when erected, as illustrated in FIG. 2. The alignment and positioning of the box is clearly effected by the floor panel 11, the middle panel 12, and the top wall panel 13** proportioned of substantially equal square panel members.

As to the manner of usage and operation of the present invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-compartmented box blank comprising, a single "L" shaped blank including a top panel member, a floor panel member, and a middle panel member, the floor panel member includes a first wall hingedly mounted coextensively to a top edge of the floor panel member, and a left side wall panel positioned medially of and hingedly coextensively mounted to the floor panel member and to the middle panel, and a bottom side wall panel positioned medially of and hingedly mounted coextensively to the floor panel member and the top panel member intermediate the top panel member and the floor panel member.

2. A multi-compartmented box blank as set forth in claim 1 wherein the floor panel member further includes a right side wall hingedly mounted to the floor panel member coextensively to a right side of the floor panel member, and further including a further right side wall hingedly mounted to the right side wall, and the further right side wall including a plurality of positioning tabs directed outwardly of the further right side wall, and the right side wall including a plurality of enclosed slots aligned with the positioning tabs, wherein the slots are directed through the floor panel member contiguously with the right side wall.

3. A multi-compartmented box blank as set forth in claim 2 wherein the left side wall panel includes a further plurality of positioning tabs aligned with the positioning tab of the further right side wall.

4. A multi-compartmented box blank as set forth in claim 3 wherein the middle panel member includes an upper flap wall coextensively and hingedly mounted to a top edge of the middle panel member, and a middle panel end flap coextensively and hingedly mounted to a left edge of the middle panel member, and a lower flap wall hingedly mounted coextensively to a bottom edge of the middle panel member.

5. A multi-compartmented box blank as set forth in claim 4 wherein the bottom side wall panel is hingedly mounted to a bottom edge of the floor panel member and to a top edge of the top panel member, wherein the bottom side wall panel is of a predetermined width substantially twice that defined by the first wall, the right side wall and the further right side wall.

6. A multi-compartmented box blank as set forth in claim 5 wherein the top panel member includes a forward wall portion hingedly mounted to a lowermost edge and coextensively to the lowermost edge of the top panel member, and the forward wall portion includes a lock panel formed with tapered sides coextensively and hingedly mounted to the forward wall portion remote from the top wall panel.

7. A multi-compartmented box blank as set forth in claim 6 wherein the top wall panel includes a left and a right panel member each hingedly and respectively secured to left and right side edges of the top panel member.

* * * * *